US006324759B1

(12) United States Patent
Sasano et al.

(10) Patent No.: US 6,324,759 B1
(45) Date of Patent: Dec. 4, 2001

(54) METHOD OF MAKING A FILLER NECK OF RADIATOR

(75) Inventors: Norihisa Sasano, Ama-gun; Yoshihiro Iwata, Nishio; Masanori Iyama, Kariya; Satomi Muto, Nishikasugai-gun; Takaaki Sakane, Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/534,099

(22) Filed: Mar. 23, 2000

(30) Foreign Application Priority Data

Mar. 30, 1999 (JP) ..... 11-089793

(51) Int. Cl.[7] ..... B23P 15/26
(52) U.S. Cl. ..... 29/890.03; 29/557
(58) Field of Search ..... 29/890.03, 557; 123/41.44, 41.01; 165/104.34, 104.32

(56) References Cited

U.S. PATENT DOCUMENTS 3,265,048 * 8/1966 Herbon ..... 123/41.54
3,809,150 * 5/1974 Holmes ..... 123/41.54
4,358,051 * 11/1982 Hunt ..... 123/41.51
4,492,267 * 1/1985 Caders ..... 123/41.54
4,809,773 3/1989 Susa et al. .

FOREIGN PATENT DOCUMENTS

U-3-14057 2/1991 (JP) .
A-3-114657 5/1991 (JP) .

* cited by examiner

*Primary Examiner*—I Cuda Rosenbaum
(74) *Attorney, Agent, or Firm*—Harness, Dickey & Pierce, PLC

(57) ABSTRACT

A filler neck is connected to a connection pipe attached to a pouring port of a header tank of a radiator. A radiator cap having a pressure valve and an overflow pipe connected to a reservoir are attached to the filler neck. The filler neck has a cylindrical portion which includes an annular pressure-valve sealing portion making contact with the pressure valve, an opening formed inside an inner diameter of the pressure-valve sealing portion to communicate with the connection pipe and an opening peripheral portion formed along a periphery of the opening. The opening peripheral portion is disposed above a lower end of the overflow pipe. The filler neck is formed by pressing a metal plate. Therefore, the filler neck made of metal is readily formed into a shape substantially equal to that of a resin filler neck.

2 Claims, 5 Drawing Sheets

METHOD OF MAKING A FILLER NECK OF RADIATOR

CROSS REFERENCE TO RELATED APPLICATIONS

This application relates to and claims priority from Japanese Patent Application No. 11-89793 filed on Mar.30, 1999, the contents of which are hereby incorporated by reference.

BACKGROUND OF THE INVENTION

1. Field of the Invention

The present invention relates generally to radiators, and particularly to a filler neck of a radiator connected to a pouring port of a header tank of the radiator.

2. Related Art

Conventionally, a radiator has a filler neck connected to a connection pipe attached to a pouring port of a header tank of the radiator. An overflow pipe connected to a reservoir of coolant through a rubber pipe and a pressure-type radiator cap are attached to the filler neck. JP-A-62-282111 discloses a radiator having a filler neck integrally formed with an overflow pipe, a connection pipe and a header tank of the radiator using resin. The filler neck has a pressure-valve sealing portion which makes contact with a pressure valve of a radiator cap attached to the filler neck. The pressure-valve sealing portion is disposed above an axis of the overflow pipe so that a height of the radiator including the radiator cap is reduced.

Recently, improvement of recycling performance of vehicle parts such as a radiator is demanded to reduce industrial waste. However, the above-mentioned radiator is made of at least two kinds of materials including metal used for a core portion of the radiator and resin used for the header tank and the filler neck. Therefore, metal parts and resin parts of the radiator may have to be divided for recycling. As a result, the number of processes for recycling the parts is increased, and recycling performance of the radiator is low.

SUMMARY OF THE INVENTION

When a filler neck is made of metal such as aluminum, it is difficult to form the filler neck into a shape substantially same as that of a resin filler neck. Therefore, when all parts of a radiator including a filler neck are made of metal, a height of the radiator including a radiator cap may become larger than that of a radiator having a resin filler neck.

In view of the foregoing problems, it is an object of the present invention to provide a metal filler neck of a radiator which reduces a height of the radiator including a radiator cap to that of a radiator having a resin filler neck.

According to the present invention, a filler neck of a heat exchanger is detachably connected to three of a pouring port of a header tank of the heat exchanger, a pipe extending in a substantially horizontal direction and a filler cap having a pressure valve for the heat exchanger. The filler neck has a cylindrical portion. The cylindrical portion includes an annular valve sealing portion which makes contact with the pressure valve, an opening formed inside an inner diameter of the valve sealing portion to communicate with the header tank, and an opening peripheral portion connected to the valve sealing portion and formed along a periphery of the opening. The opening peripheral portion is disposed above a lower end of the pipe. The filler neck is formed by pressing a metal plate.

The filler neck is readily formed by pressing a metal plate into the above-mentioned shape substantially equal in size to a resin filler neck even when the filler neck is made of metal. Therefore, a height of the heat exchanger having the metal filler neck is reduced to that of a heat exchanger having the resin filler neck. Further, since all parts of the heat exchanger including the filler neck are made of metal, recycling performance of the heat exchanger is improved.

BRIEF DESCRIPTION OF THE DRAWINGS

This and other objects and features of the present invention will become more readily apparent from a better understanding of the preferred embodiments described below with reference to the accompanying drawings, in which.

DETAILED DESCRIPTION OF THE PREFERRED EMBODIMENTS

Preferred embodiments of the present invention are described hereinafter with reference to the accompanying drawings.

(First Embodiment)

Figure 1:
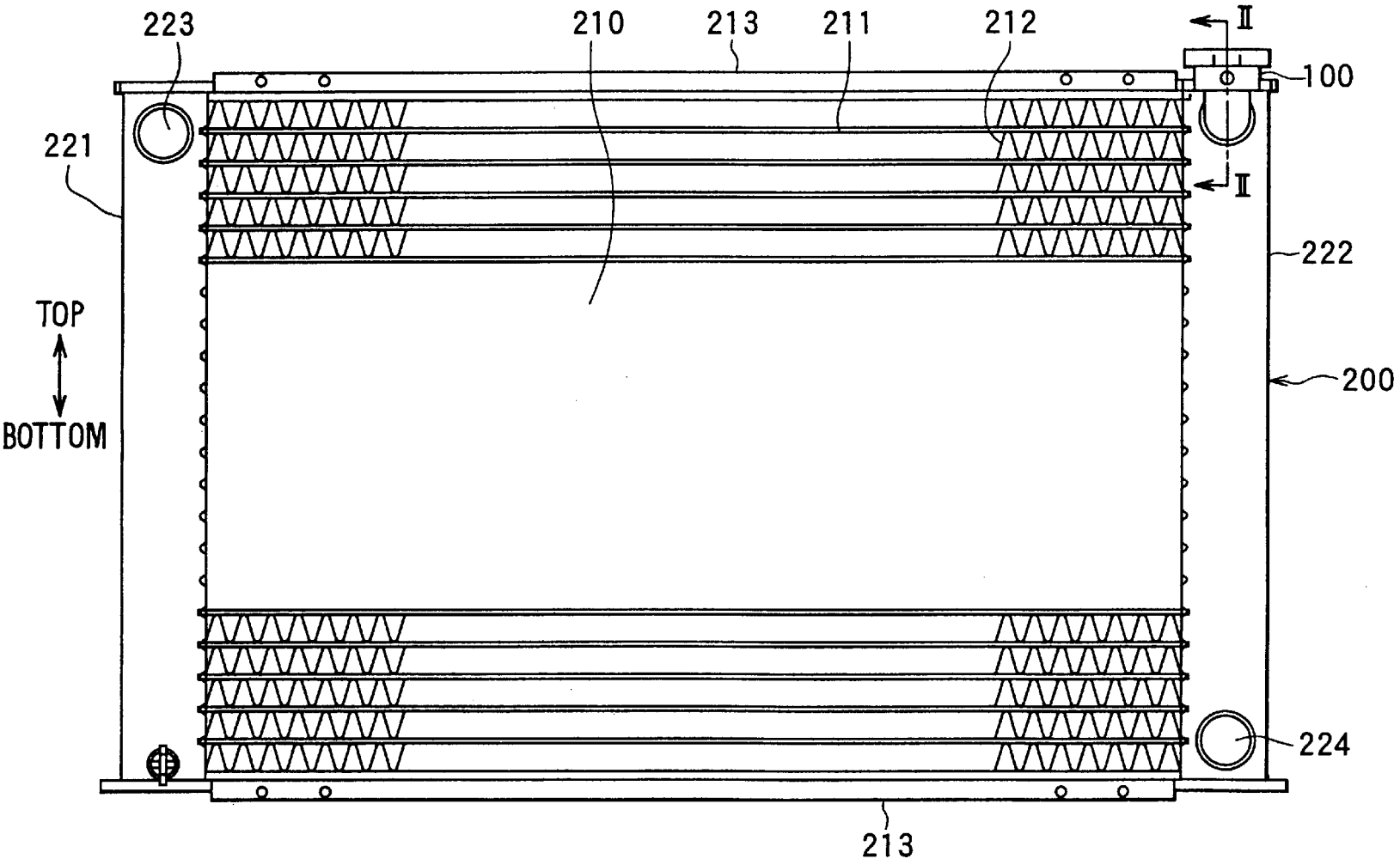
FIG. 1 is a schematic front view showing a radiator having a filler neck according to a first preferred embodiment of the present invention.

A first preferred embodiment of the present invention will be described with reference to FIGS. 1–3J. In the first embodiment, a filler neck of the present invention is applied to a radiator for a vehicle. In FIG. 1, a radiator 200 for a vehicle having a filler neck 100 is viewed from a downstream air side with respect to air passing through the radiator 200.

As shown in FIG. 1, the radiator 200 has plural flat tubes 211 through which coolant discharged from an engine (not shown) of the vehicle flows. First and second header tanks 221, 222 are respectively disposed at one flow-path end (i.e., left end in FIG. 1) of the tubes 211 and the other flow-path end (i.e., right end in FIG. 1) of the tubes 211 to extend in a direction perpendicular to a longitudinal direction of the tubes 211 and to communicate with the tubes 211. Coolant from the engine is introduced into the first header tank 221 through an inlet port 223, and is distributed into each of the tubes 211. Coolant is heat-exchanged with air passing through the radiator 200 while flowing through the tubes 211, and is collected into the second header tank 222. Coolant in the second header tank 222 is discharged toward the engine through an outlet port 224. The inlet port 223 is connected to a coolant outlet of the engine, and the outlet port 224 is connected to a coolant inlet of the engine.

Plural cooling fins 212 are disposed between adjacent tubes 211 for facilitating heat exchange between coolant and air passing through the radiator 200. The tubes 211 and the fins 212 form a core portion 210 of the radiator 200. Further, a pair of side plates 213 are respectively disposed at upper and lower ends of the core portion 210 in FIG. 1 to extend in parallel with the tubes 211 for reinforcing the core portion 210. The side plates 213, the tubes 211, the fins 212 and the first and second header tanks 221, 222 are made of aluminum and are integrally brazed together.

Figure 2:
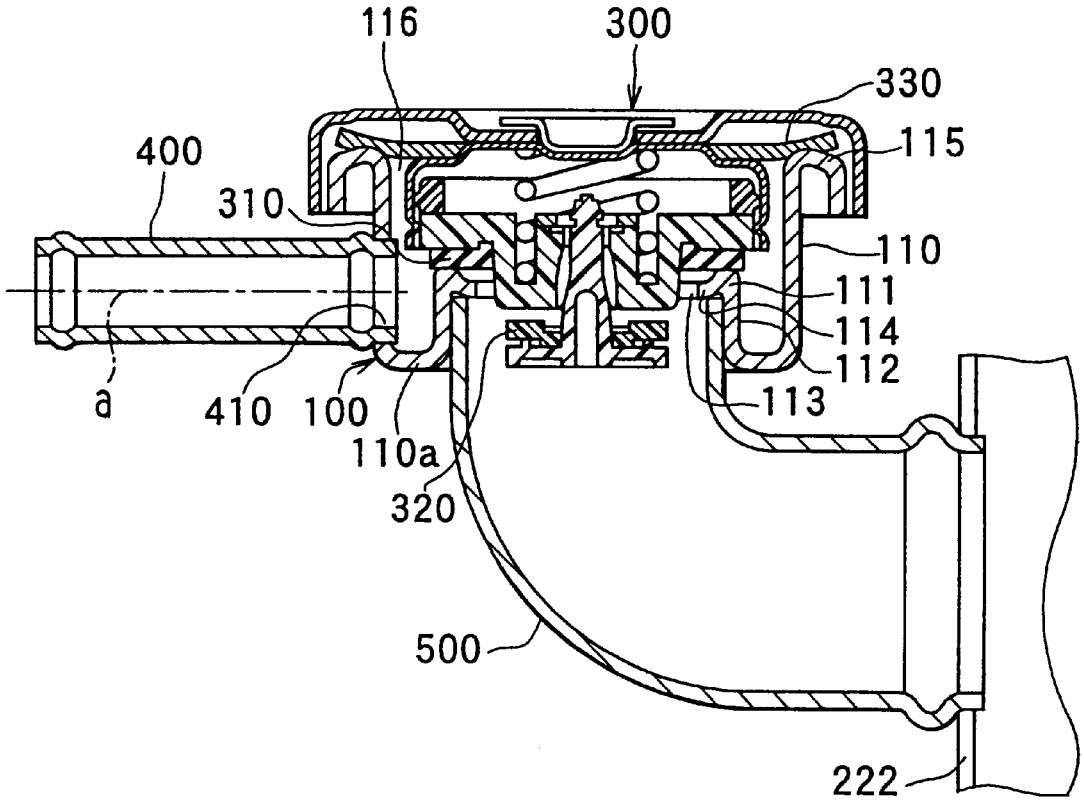
FIG. 2 is a sectional view taken along line II—II in FIG. 1.

Next, the filler neck 100 and a coolant pouring structure of the radiator 200 will be described in detail with reference to FIG. 2. As shown in FIG. 2, a well-known pressure-type radiator cap 300 has a pressure valve 310, a vacuum valve 320 and a closing valve 330. The pressure valve 310 is opened when a pressure inside the second header tank 222 exceeds a predetermined value. The vacuum valve 320 is opened when a pressure inside the second header tank 222 becomes less than the predetermined pressure. The filler neck 100 has a filler neck body portion 110 which forms a pouring opening 116. The closing valve 330 closes the pouring opening 116.

An overflow pipe 400 is connected to a reservoir (not shown) which stores coolant therein through a rubber pipe. The overflow pipe 400 is connected to the filler neck 100 to protrude from the body portion 110 in a substantially horizontal direction. A connection pipe 500 is connected to a side surface of the second header tank 222 and to the filler neck 100. In the first embodiment, the connection pipe 500, the overflow pipe 400 and the filler neck 100 are made of aluminum. The filler neck 100 is made of clad aluminum clad with brazing material on one side surface thereof. The connection pipe 500 and the overflow pipe 400 are brazed to the filler neck 100 by the brazing material clad on the surface of the filler neck 100.

The filler neck 100 has a cylindrical portion 112 integrally formed with the body portion 110 by pressing. The cylindrical portion 112 has an annular pressure-valve sealing portion 111 which makes contact with the pressure valve 310, an opening 113 formed inside an inner diameter of the pressure-valve sealing portion 111 to communicate with the connection pipe 500, and an opening peripheral portion 114 connected to the pressure-valve sealing portion 111 and formed along a periphery of the opening 113. The pressure-valve sealing portion 111 and the opening peripheral portion 114 are disposed above a lower end portion 410 of an inner wall of the overflow pipe 400. That is, the pressure-valve sealing portion 111 and the opening peripheral portion 114 are disposed above an axis "a" in FIG. 2 of the overflow pipe 400. The connection pipe 500 is brazed to an inner wall of the cylindrical portion 112. The body portion 110 has a bottom portion 110*a* and a closing-valve sealing portion 115 which makes contact with the closing valve 300.

Figures 3A, 3B, 3C, 3D, 3E:
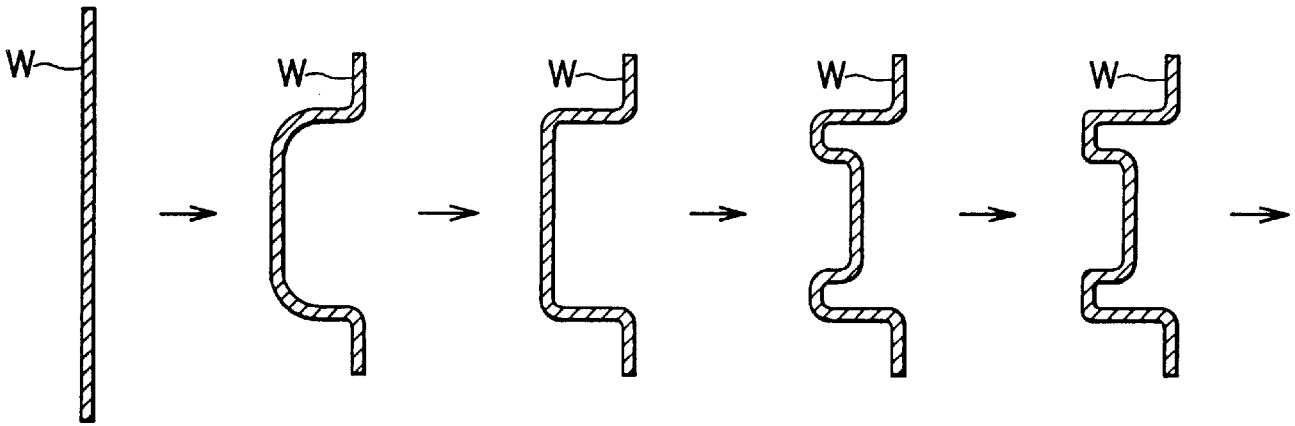
FIGS. 3A–3J are schematic views showing manufacturing processes of the filler neck according to the first embodiment.
Figures 3F, 3G, 3H, 3I, 3J:
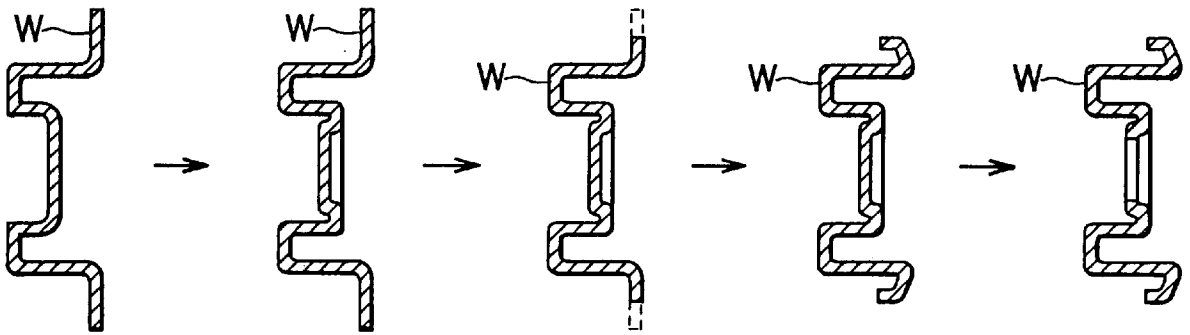

Next, a manufacturing method of the filler neck 110 by pressing will be described with reference to FIGS. 3A–3J. First, as shown in FIGS. 3A–3C, a metal plate w is formed into a hat-shape by deep-drawing (first and second pressing processes). That is, a portion of the metal plate w is drawn by a dimension sufficiently larger than a thickness of the metal plate w. Next, as shown in FIGS. 3D–3F, the metal plate w is deformed to have the cylindrical portion 112 by deep-drawing in a direction opposite to that of the first and second pressing processes (third, fourth and fifth pressing processes). Then, as shown in FIG. 3G, the metal plate w is deformed to have the pressure-valve sealing portion 111 by drawing by a dimension substantially equal to the thickness of the metal plate w in the same direction as that of the first and second pressing processes (sixth pressing process). Further, as shown in FIGS. 3H and 3I, the metal plate w is deformed to have the closing-valve sealing portion 115 (seventh and eighth pressing processes). Finally, as shown in FIG. 3J, the opening 113 is formed by boring a center part of the metal plate w (ninth pressing process). Thus, the filler neck 100 is formed.

According to the first embodiment, the opening peripheral portion 114 of the filler neck 100 is disposed above the lower end portion 410 of the overflow pipe 400. Therefore, the metal plate w does not need to be deep-drawn in the sixth pressing process in FIG. 3G. That is, a deep-drawn portion of the metal plate w formed in the third through fifth pressing processes in FIGS. 3D–3F does not need to be further deep-drawn in an opposite direction to that of the deep-drawn portion. As a result, even when the filler neck 100 is made of metal such as aluminum instead of resin, the filler neck 100 having a shape similar to that of a resin filler neck is readily formed by pressing. Therefore, the filler neck 100 made of metal is substantially equal in size to a resin filler neck, and a height of the radiator 200 including the radiator cap 300 is reduced to that of a radiator having a resin filler neck. Further, in the first embodiment, all parts of the radiator 200 including the filler neck 100 are made of metal such as aluminum. Therefore, recycling performance of the radiator 200 is improved.

(Second Embodiment)

A second preferred embodiment of the present invention will be described with reference to FIG. 4. In this and following embodiments, components which are substantially the same as those in previous embodiments are assigned the same reference numerals.

Figure 4:
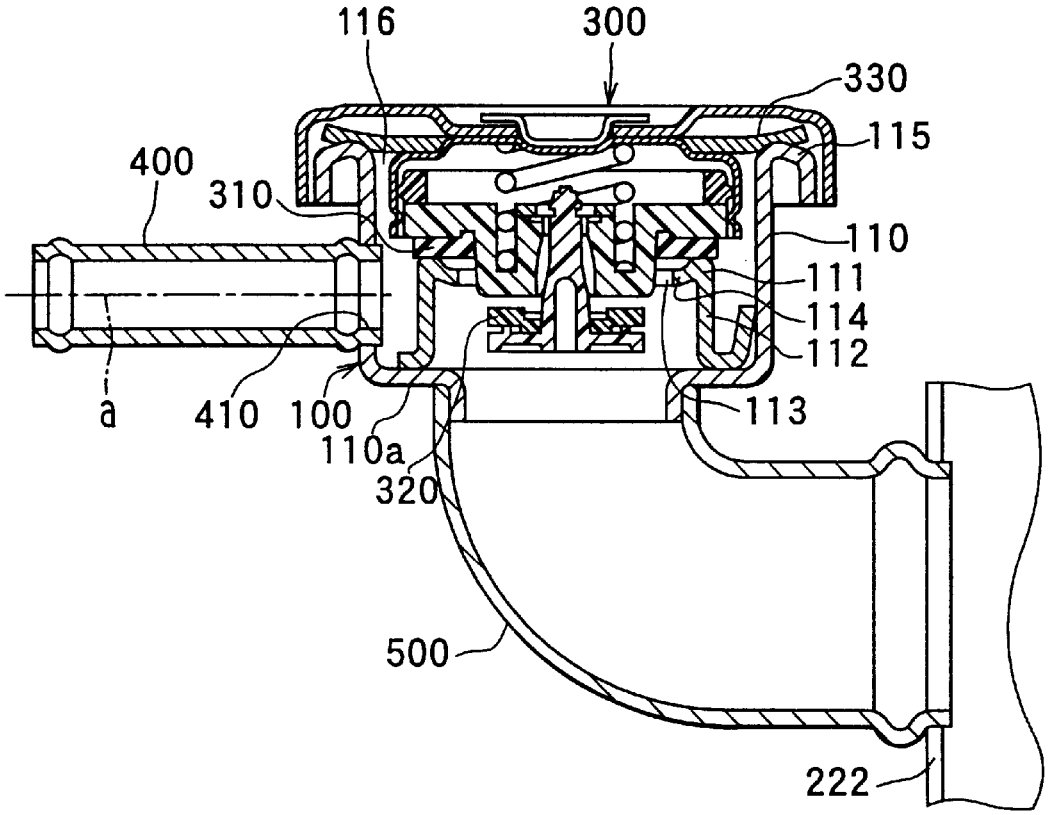
FIG. 4 is a sectional view showing a filler neck, a radiator cap, an overflow pipe and a connection pipe of a radiator according to a second preferred embodiment of the present invention.

In the second embodiment, as shown in FIG. 4, the cylindrical portion 112 and the body portion 110 of the filler neck 100 are separately formed using metal such as aluminum by pressing. Thereafter, the cylindrical portion 112 is disposed inside the body portion 110 and is brazed to the body portion 110 so that the pressure-sealing portion 111 is disposed above the lower end portion 410 of the overflow pipe 400 and the bottom portion 110*a* of the body portion 110, similarly to the first embodiment. The connection pipe 500 is connected to the body portion 110.

According to the second embodiment, the filler neck 100 having a shape similar to that of a resin filler neck is readily formed using metal.

(Third Embodiment)

Figure 5:
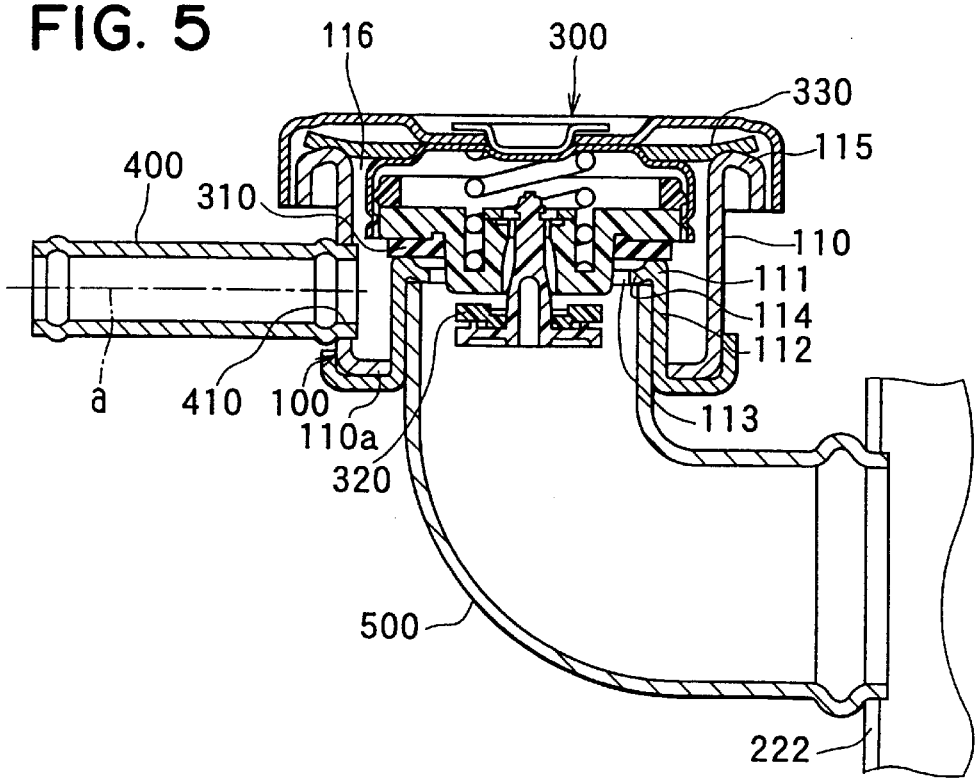
FIG. 5 is a sectional view showing a filler neck, a radiator cap, an overflow pipe and a connection pipe of a radiator according to a third preferred embodiment of the present invention.

A third preferred embodiment of the present invention will be described with reference to FIG. 5. In the third embodiment, as shown in FIG. 5, the cylindrical portion 112 is separately formed from the body portion 110 similarly to the second embodiment, but the connection pipe 500 is connected to the cylindrical portion 112, instead of the body portion 110. According to the third embodiment, the similar effect in the second embodiment is obtained.

(Fourth Embodiment)

Figure 6:
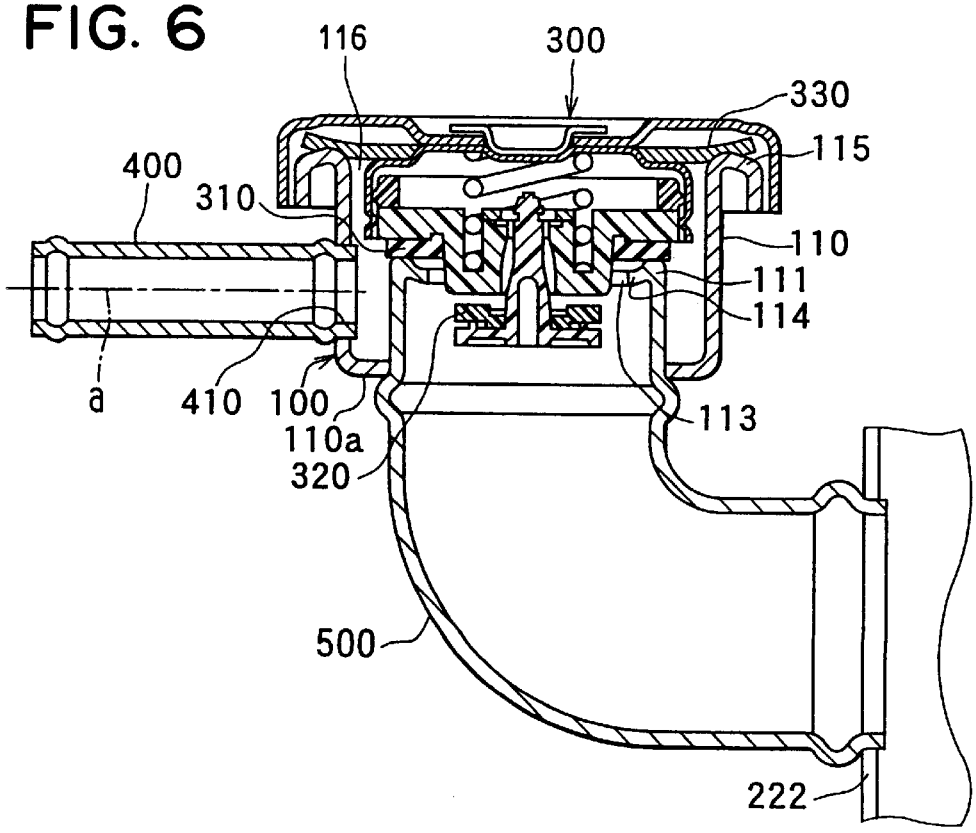
FIG. 6 is a sectional view showing a filler neck, a radiator cap, an overflow pipe and a connection pipe of a radiator according to a fourth preferred embodiment of the present invention.

A fourth preferred embodiment of the present invention will be described with reference to FIG. 6. In the fourth embodiment, as shown in FIG. 6, an end portion of the connection pipe 500 is used as the cylindrical portion 112. Therefore, the pressure-valve sealing portion 111 is formed at the end portion of the connection pipe 500.

According to the fourth embodiment, the cylindrical portion 112 and the body portion 110 are separately formed. Therefore, similarly to the second and third embodiments, the filler neck 100 having a shape similar to that of a resin filler neck is readily formed using metal. Further, since the cylindrical portion 112 does not need to be formed independently, the number of parts of the radiator 200 is reduced, thereby reducing a manufacturing cost of the radiator 200.

In the above-mentioned embodiment, each of the overflow pipe 400 and the connection pipe 500 may be brazed to the filler neck 100 using brazing material clad on one-side surface of the overflow pipe 400 and the connection pipe 500. Further, the present invention does not limited to a radiator for a vehicle, but may be applied to any heat exchanger through which fluid flows. Also, in the above-mentioned embodiments, the connection pipe 500 may be omitted while the filler neck 100 is directly connected to the second header tank 222.

Although the present invention has been fully described in connection with preferred embodiments thereof with reference to the accompanying drawings, it is to be noted that various changes and modifications will become apparent to those skilled in the art. Such changes and modifications are to be understood as being within the scope of the present invention as defined by the appended claims.

What is claimed is:

1. A method of manufacturing a filler neck for a heat exchanger using a metal plate, the method comprising steps of:

forming the metal plate into a hat-shape by deep-drawing in a first direction with a dimension sufficiently larger than a thickness of the metal plate;

deforming the metal plate to have a cylindrical portion by deep-drawing in a second direction opposite to the first direction with a dimension sufficiently larger than the thickness of the metal plate;

deforming the cylindrical portion to have a valve sealing portion by drawing in the first direction with a dimension substantially equal to the thickness of the metal plate; and boring a center part of the cylindrical portion to form an opening.

2. The method of manufacturing the filler neck of claim 1, wherein:

the valve sealing portion makes contact with a pressure valve of a filler cap of the heat exchanger; and the valve sealing portion is disposed above a lower end of an overflow pipe of the heat exchanger, the overflow pipe extending in a substantially horizontal direction.

* * * * *